United States Patent [19]

Hehl

[11] Patent Number: 4,627,682

[45] Date of Patent: Dec. 9, 1986

[54] MULTI-PIN MALE AND FEMALE CONTACT BARS

[76] Inventor: Karl Hehl, Arthur-Hehl-Strasse 32, 7298 Lossburg 1, Fed. Rep. of Germany

[21] Appl. No.: 635,539

[22] Filed: Jul. 30, 1984

[30] Foreign Application Priority Data

Jul. 29, 1983 [DE] Fed. Rep. of Germany ..... 3327387

[51] Int. Cl.[4] ..... H01R 4/24; H01R 4/02

[52] U.S. Cl. ..... 339/99 R; 29/879; 339/275 T; 339/276 SF

[58] Field of Search ..... 339/17 CF, 17 LC, 17 C, 339/97-99, 119 R, 125 R, 126 R, 128, 176 MP, 191 M, 192 R, 210 R, 210 M, 217 R, 220 R, 220 M, 221 R, 221 M, 258 R, 258 P, 262 R, 262 F, 275 R, 275 T, 278 M, 278 T, 276 SF; 29/877-880

[56] References Cited

U.S. PATENT DOCUMENTS

| | | | |
|---|---|---|---|
| 2,799,840 | 7/1957 | Barnes | 339/275 T |
| 3,107,963 | 10/1963 | Hansen | 339/192 R |
| 3,381,262 | 4/1968 | Jeanrenaud | 339/258 R |
| 3,646,500 | 2/1972 | Wessely | 339/258 R |
| 3,778,753 | 12/1973 | Occhipinti et al. | 339/176 MP |
| 3,990,768 | 11/1976 | Faber | 339/210 R |
| 4,501,464 | 2/1985 | Bogese II | 339/17 C |

FOREIGN PATENT DOCUMENTS

| | | |
|---|---|---|
| 2841990 | 4/1980 | Fed. Rep. of Germany . |
| 8118274 | 10/1981 | Fed. Rep. of Germany . |

OTHER PUBLICATIONS

Electronic Design, Cannon Micro-D Plugs, p. 31, 7-2-7-1962.

*Primary Examiner*—Neil Abrams
*Attorney, Agent, or Firm*—Joseph A. Geiger

[57] ABSTRACT

Multi-pin male and female contact bars with composite contact posts having U-shaped upper contact post portions with two spaced tines and a transverse web portion to which is butt-welded a pin with an enlarged attachment head. The tines serve as spring tines of female contact members, or as cable-penetrating contact blades of male contact members, the associated butt-welded pins being solder pins for connection to a printed circuit board or male plug pins, respectively. The upper contact post portions are produced as die-cut segments of a sheet metal strip which remain connected to a carrier strip, until inserted into the contact post housing of the contact bar and severed from the carrier strip by a break-away movement.

5 Claims, 55 Drawing Figures

10'
17f
17h
F
17
18d
17f'
17b'
11
15
17b
19
17d'
17c'
17b'
17f'
III
III
V
V
17d
17c
17e

IX
IX

Fig.17
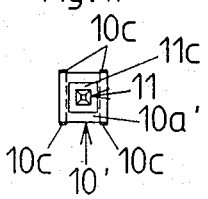
Fig.20
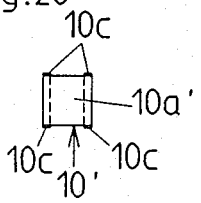
Fig.25
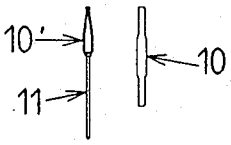
Fig.26
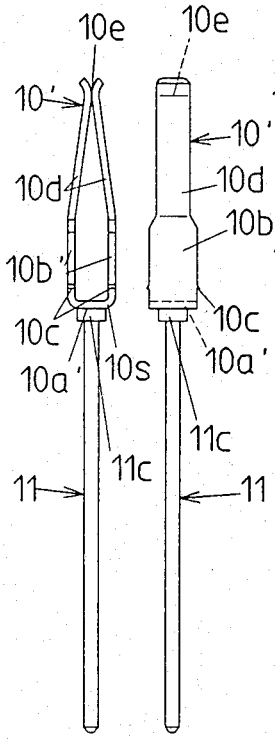
Fig.18
Fig.19
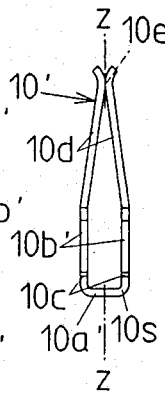
Fig.21
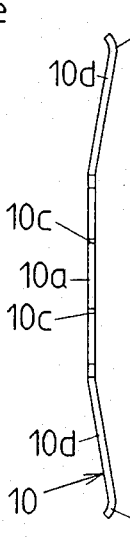
Fig.22
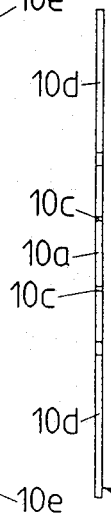
Fig.23
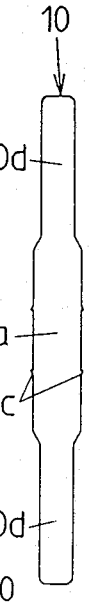
Fig.24

Fig.27
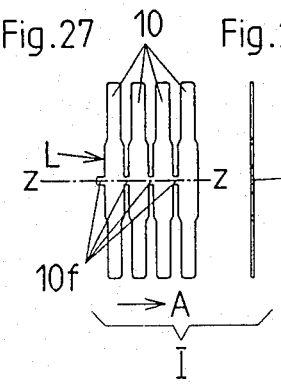
Fig.28
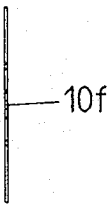
Fig.29
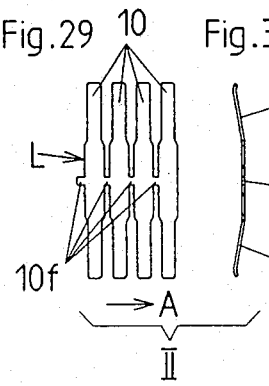
Fig.30
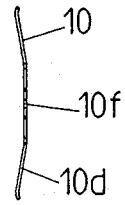
Fig.31
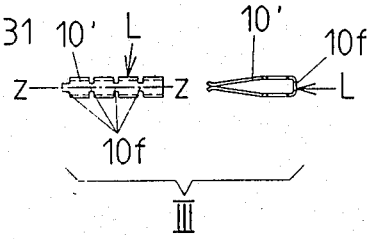
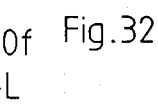
Fig.32
Fig.33
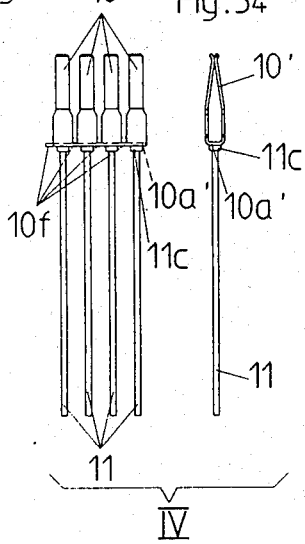
Fig.34
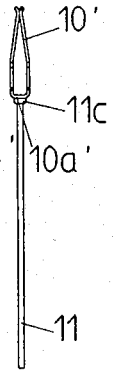
Fig.35
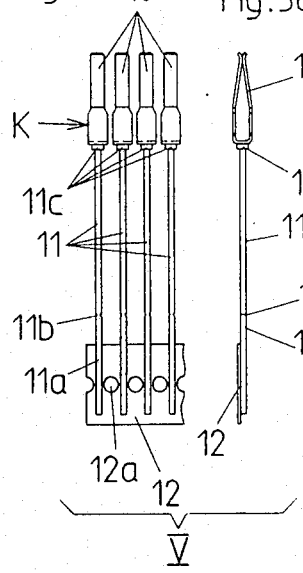
Fig.36
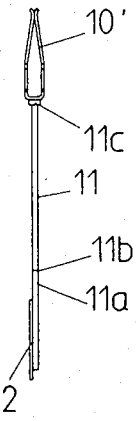

13'
13
13a
13j
13h
13i
13t
13m'
13n'
13s
13k
14c
14
14a
14b
13f
13n
35
35a
L'
K'
I
II
III
IV

MULTI-PIN MALE AND FEMALE CONTACT BARS

BACKGROUND OF THE INVENTION

1. Field of the Invention

The present invention relates to electrical multi-pin plug connections and, more particularly, to multi-pin male and female contact bars which are adapted for the connection of multi-conductor flat ribbon cables to a printed circuit board or to other cables. It also relates to a method of manufacturing and assembling composite contact posts for such multi-pin contact bars.

2. Description of the Prior Art

The rapid growth in the use and transmission of electronic data and signals, in conjunction with the advantages which can be realized through structural modularity and the application of the building block principle to the electronic controls of complex production machines, for example, has created a need for multi-conductor plug connections in the form of compact, standardized male and female contact bars forming large numbers of contacts for the pluggable connection of wire harnesses to printed circuit boards and for wire harness couplings.

In order to achieve very closely spaced contact positions, and with the aim of establishing reliable solder-free electrical connections between the metallic contact members and the conductor strands of a multi-conductor cable, it has already been suggested to produce the numerous closely spaced electrical connections by means of a contact blade configuration in which each contact post terminates in a yoke-shaped contact blade with a central slot by means of which the contact member engages the conductor strand. The forcible engagement of the contact blade over a conductor causes the contact blade to locally penetrate and displace the insulating sheath surrounding the conductor strand and to firmly wedge the strand wire between the flanks of the blade slot.

The German Offenlegungsschrift (Published Application) No. 27 47 264 discloses a multi-conductor contact bar which holds a row of female contact posts with two conductor penetrating blades guided in a plastic housing. The connection of such a contact bar to a printed circuit board necessitates the use of a special intermediate pin bar with pins having one extremity attached to the solder sockets of the printed circuit board and the other extremity engaged by the female contact posts of the contact bar.

The contact posts of this prior art contact bar are arranged in a single row and symmetrical with respect to both the longitudinal axis and a plane which is perpendicular to that axis. The smallest pitch of the conductor strands in a ribbon cable attached to this contact bar is equal to the longitudinal distance between two contact posts in the plastic contact bar housing.

These prior art contact posts have two parallel blade tines linked by a transverse web portion in the center of which is arranged a socket opening for the insertion of a contact pin. A long slot which extends from the socket opening into the blade tines gives the contact post a limited degree of flexibility.

The structure of these contact posts lends itself to the mechanized die-cutting of the contact posts from a continuous strip of sheet metal which can be surface-treated and stored as a coil of semi-finished contact post segments. However, the assembly of these contact posts into a contact bar requires a complex automatic assembly machine which must first bend the contact post segments from a flat shape into the shape of a "U", then sever them from the sheet metal segment strip in a cutting action, and finally insert the contact posts into the contact bar housing.

The electrical connections between the contact blades of the contact posts and the conductor strands of the ribbon cable are established in the process of inserting the contact posts into the contact bar housing. Accordingly, it is not possible to attach such a contact bar to a ribbon cable in the field, where the special assembly machine is not available.

From the German Offenlegungsschrift No. 27 24 244, which corresponds to U.S. Pat. No. 4,068,912, it is known to arrange two adjacent rows of contact members in a common contact bar housing with a longitudinal offset between the two rows which is equal to one-half of the contact member pitch. Such a contact bar is connectable to a ribbon cable with conductor strands spaced at one-half the pitch of the contact members.

This prior art solution, while lending itself to the use with ribbon cables of very small pitch, has the shortcoming of having only one contact blade for each conductor strand, with the additional disadvantage of using the contact posts themselves as locking elements for the attachment of the cable clamping member to the contact bar housing.

This locking action is obtained by forcing each contact blade through a tapered slot in the cable clamping member, thereby causing the two lobes of the blade to be deflected towards each other. Only after the contact blade has been fully inserted, are the blade lobes allowed to spring back to their normal spacing, their latching protrusions thereby becoming engaged behind interior supporting shoulders of the housing.

It follows that, as the contact blades penetrate the conductor sheath to wedge their slot flanks against the conductor strands, the slots are, in effect, narrower than in the fully inserted position of the contact posts, with the result that the metal-to-metal contact pressure between the contact blades and the conductor strands is relaxed, rather than maintained or increased, as the blades snap into their locking positions.

Also known from the prior art is a composite female contact post which consists of a contact portion in the form of a pair of spring tines connected together by a bridge portion and a solder pin which is welded to that bridge portion. The bridge portion adjoins the spring tines at their longitudinal edges, thus forming a wall portion which extends parallel to the center axis of the contact post and parallel to the longitudinal axis of the solder pin. The solder pin is spot-welded to the inner side of this bridge wall portion.

Past attempts at obtaining a butt-welded connection between a contact member and a pin have met with failure, due to the small area of the resistive interface at the extremity of the pins and the resultant difficulty of obtaining a consistent heat input that would prevent mere adhesion on one extreme and burn-off on the other extreme.

Another reason why it has been impossible in the past to obtain reliable butt-weld connections for the pins is related to the fact that different metal alloys are used for the two component parts of the contact posts: brass for the upper contact post portions which undergo bending in production and which must provide a spring response, in the case of the female contact members, and contact bronze for the solder pins and plug pins.

SUMMARY OF THE INVENTION

Underlying the present invention is the primary objective of providing improved composite contact posts for use in multi-pin female contact bars with solder pins which are connectable to the solder sockets of a printed circuit board and similarly structured composite contact posts for multi-pin male contact bars which are penetration-connectable to the conductors of a flat ribbon cable and can be plugged into a female contact bar. A further objective of the invention is an improved method of manufacturing and assembling composite contact posts which makes it possible to insert the contact posts as interconnected segments of a continuous strip.

The present invention proposes to attain this objective by suggesting a multi-pin contact bar with at least one row of vertical contact post apertures in an elongated contact post housing of plastic holding contact posts which are composed of upper and lower contact post portions, the upper contact post portion having a U-shaped outline defined by a pair of substantially parallel vertical tines and a transverse web portion joining the vertical tines at their lower extremities, the lower contact post portion being butt-welded to the lower side of the transverse web portion, so as to protrude downwardly from the contact post aperture.

In a preferred embodiment of the invention, the lower contact post portion is a pin which extends parallel to the two tines of the upper contact post portion and has its upper extremity upset to form an enlarged attachment head by which it is butt-welded to the transverse web portion of the upper contact post portion.

One version of the contact post is intended to serve as a female contact member with a solder pin for connection to a printed circuit board. In this case, the two tines of its upper portion have converging upper end portions which are adapted to receive between them a male plug pin, while applying to the latter a pinching contact force, as they yield resiliently in opposition to a closing preload.

Another version of the contact post is intended to serve as a cable-penetrating contact member with a male plug pin for the termination of a flat ribbon cable with a male contact bar. In this case, the tines of the upper contact post portion define two yoke-shaped contact blades with transversely aligned central blade slots which pinch each conductor strand at two spaced contact points.

A third version of the composite contact post is intended to serve as a cable-penetrating contact member with a female contact member for the termination to a flat ribbon cable with a female contact bar which can be plugged into the aforementioned male contact bar. This contact post version uses for its upper portion the same female contact member as is used by the first version, while the lower contact post portion is similar to the upper contact post portion of the second version, viz. a second U-shaped member with two spaced tines joined by a transverse web portion. The two tines, though shorter in this case, form contact blades with central blade slots.

In both cases in which cable-penetrating contact blades are used, the contact posts are preferably arranged in two rows and the contact blades are longitudinally offset form the plug pins, or female contact members, respectively, by one-quarter of the longitudinal contact post pitch, so that, when the contact posts of the two rows are oriented in opposite directions, their blade slots are offset by one-half of the pitch, for connection to a ribbon cable with conductors which are spaced at one-half the pitch of the contact post in the contact bar.

As part of a method of manufacturing and assembling the proposed novel contact bars, the present invention further suggests that the upper portions of the composite contact posts be die-shaped as interconnected segments of a continuous sheet metal segment strip and bent along to lines to form the two spaced tines and a transverse web portion to which the lower contact post portions—solder pin, plug pin, or contact blade portion—are butt-welded.

In the case of the female contact bar with solder pins, the pins are over-length as they are butt-welded to the female contact members, their free over-length extremities being attached to a breakaway carrier strip. In the case of the male contact bar with plug pins, the contact blades are attached to lateral breakaway carrier strips of the sheet metal segment strip.

The arrangement of enlarged attachment heads at the butt-welded extremities of the pins assures satisfactory butt-weld connections between the web portions of the upper contact post portions and the pins. These butt-welds are obtained through electrical resistance welding.

As an alternative to resistance welding, the present invention suggests the application of laser beams as a source of welding heat. Laser welding is controllable within a narrower energy range than resistance welding, so that burn-off at the interface can be prevented, even without the use of enlarged attachment heads at the pin extremities.

BRIEF DESCRIPTION OF THE DRAWINGS

Further special features and advantages of the invention will become apparent from the description following below, when taken together with the accompanying drawings which illustrate, by way of example, preferred embodiments of the invention which are represented in the various figures as follows:

FIG. 17 shows the lower composite contact post of FIG. 13 as seen from the free end of its solder pin;

FIG. 18 shows the lower composite contact post of FIG. 13 as seen in the longitudinal direction of the contact bar;

FIG. 19 shows the composite contact post of FIG. 18 as seen in the transverse direction of the contact bar;

FIG. 20 shows the female contact member of the contact post of FIG. 17;

FIG. 21 shows the female contact member of the contact post of FIG. 18;

FIG. 22 shows an intermediate production stage of the female contact member of FIG. 21;

FIG. 23 shows the cross sectional outline of a sheet metal strip from which the female contact member of FIGS. 20–22 is die-cut;

FIG. 24 shows the flat outline of a segment of a sheet metal strip which is formed into the female contact member of FIGS. 20–22;

FIG. 25 shows the composite contact post of FIG. 18 in actual size;

FIG. 26 shows the segment of FIG. 24 in actual size;

FIGS. 27–36 show stages I through V in the production of a succession of attached composite contact posts with female contact members and solder pins;

DESCRIPTION OF THE PREFERRED EMBODIMENT

Figure 2:
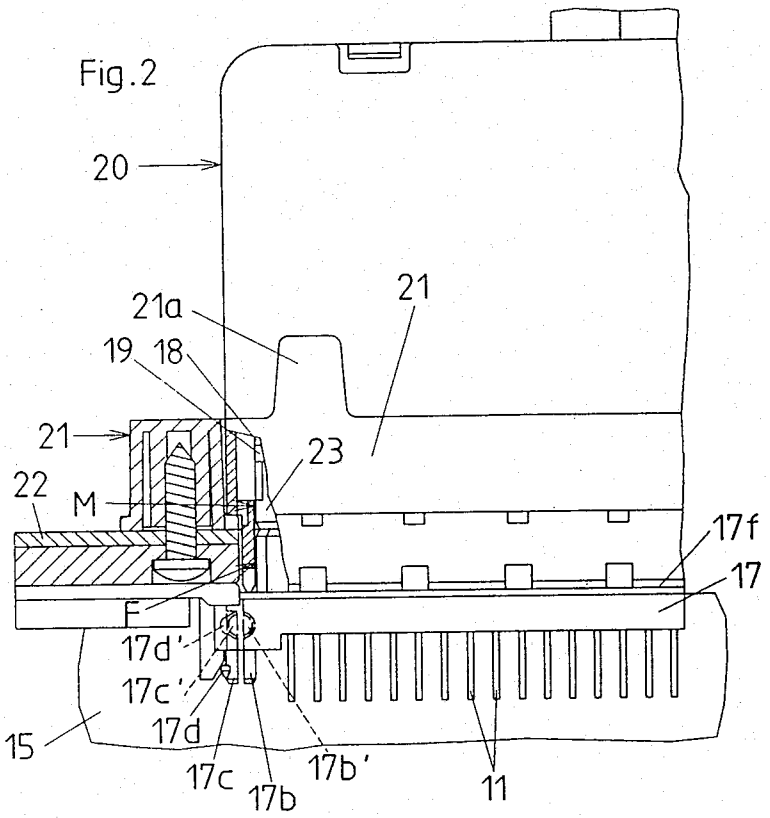
FIG. 2 shows the contact bar and plug connector of FIG. 1 in a frontal view with portions thereof cross-sectioned.
Figure 1:
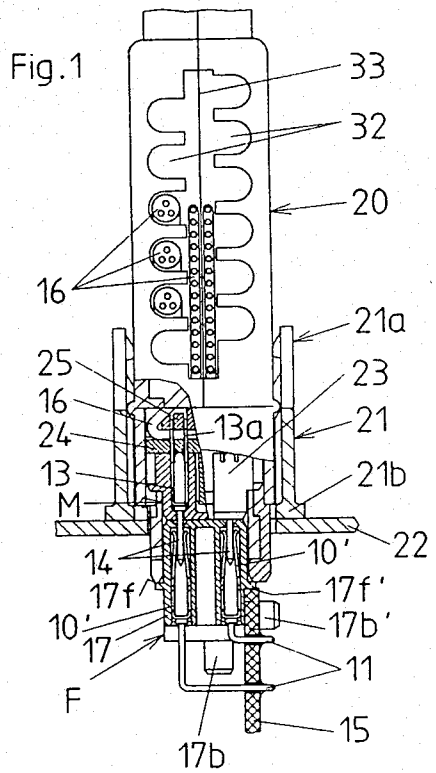
FIG. 1 shows, in a partially cross-sectioned elevational end view, a male plug connector assembly with a multi-conductor male contact bar plugged into a matching female contact bar embodying the present invention, the female contact bar being attached to a printed circuit board.

Referring to the drawings, FIGS. 1 and 2 show the use of male and female multi-pin contact bars in connection with a plug connector system which serves to connect the control components of an electronic control unit, which are arranged on a printed circuit board, with one or several multi-conductor cables leading to specific locations on a production machine.

A plug connector system of this type is disclosed in my copending U.S. patent application Ser. No. 537,174 of Sept. 29, 1983. One version of a male contact bar of the type which is incorporated in this plug connector system is disclosed in my copending U.S. patent application Ser. No. 607,127 of May 4, 1984.

To the upper edge portion of a vertical printed circuit board 15 is attached a female contact bar F which engages horizontal bores of the printed circuit board with a pair of centering lugs 17*b*. To the back wall 22 of an electronic control cabinet is attached a socket frame 21 which bears against the back wall with base flanges 21*b*.

Figure 16:
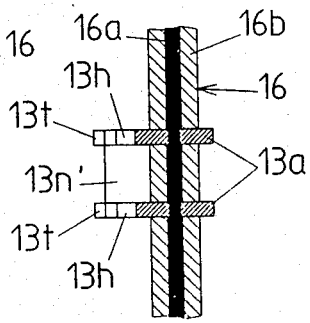
FIG. 16 is a cross section taken along line XVI—XVI of FIG. 15.
Figure 15:
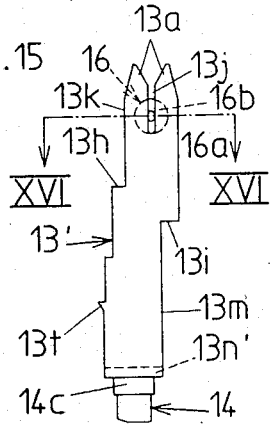
FIG. 15 shows the upper portion of FIG. 14 at a further enlarged scale.

In the socket frame 21 is engaged a plug connector 20 at the inside of which the conductor strands 16*a* (FIGS. 15 and 16) of the cable conductors 16 are terminated by means of a cable-penetrating male contact bar M. Flexible retaining tongues of the socket frame 21 secure the plug connector in its engagement position.

The plug connector is openable along a central fold plane 33, having a central slot for the entry of one or more flat ribbon cables and a number of lateral pockets 32 for the entry of round cables into the connector housing. The various conductors 16 are arranged in parallel alignment in a horizontal plane in which they are clamped between two plastic clamping members 24 and 25 of the male contact bar M.

A series of narrow guide slots in the cable clamping members 24 and 25 permit the contact blades 13*a* of each contact post 13 to reach into the plane of the conductors 16, where each contact blade 13*a* displaces a conductor sheath and pinches the conductor strand between the flanks of its central blade slot 13*j*.

The plug pins 14 of the cable-terminating male contact bar M are engaged between the elastic tines of a female contact bar F. Two rows of downwardly protruding solder pins 11 of the female contact bar have right-angle bends at two different levels, their extremities reaching through horizontal solder sockets in the printed circuit board to which they are permanently attached by means of solder connections.

The female contact member F and the male contact member M have a number of structural features in common. Inside an elongated, block-shaped contact post housing 17 (FIG. 3) or 23 (FIG. 51) of injection-molded plastic are arranged two rows of vertical contact post apertures 18 (FIG. 9) or 34 (FIG. 53), respectively, inside which are engaged two rows of regularly spaced composite contact posts 10/11 or 13/14, respectively. The contact posts are arranged at a standardized longitudinal pitch R preferably 2.54 mm.

Both types of contact posts are composed of a U-shaped upper contact post portion and a pin as a lower contact post portion. The upper portion is a bent sheet metal segment, forming two transversely spaced substantially parallel upright tines which are joined at their lower extremities by a horizontal transverse web portion.

Figure 13:
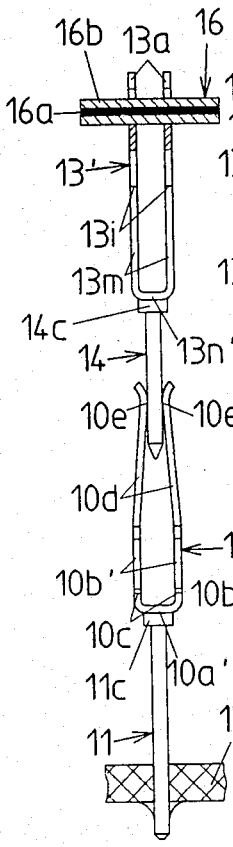
FIG. 13 shows, at an enlarged scale, two different composite contact posts plugged together, the lower contact post consisting of a female contact member and a solder pin, and the upper contact post consisting of a pair of cable-penetrating contact blades and a male plug pin.

In the case of the contact post of the female contact bar F, the two tines 10*b'* (FIGS. 13 and 14) have flexible upper end portions 10*d* on the upper contact post portion 10' which converge to form a resiliently yielding socket into which the plug pin 14 of a male contact post is engageable, under separation of the end portions 10*d*, in opposition to a closing preload on the flexible tine end portions 10*d*, which thereby produce a pinching contact force against the plug pin.

To the lower side of the transverse web portion 10*a'* which links the two tines 10*b'* is butt-welded a solder pin 11 of square cross section (FIGS. 17–19). The attachment point for the solder pin 11 is located in the center of the transverse web portion 10*a'*, and the pin extends parallel to and halfway between the two planes defined by the tines 10*b'*. At the attachment extremity, the solder pin 11 is upset prior to the welding operation, in order to form an enlarged attachment head 11*c* for a larger weld area.

In the case of the contact post of the male contact bar M, the two tines 13*m* are parallel over their entire length, forming on their upper end portions a pair of yoke-shaped contact blades 13'. The contact blades 13' have central blade slots 13*j* with parallel flanks which diverge outwardly in the vicinity of the contact blade extremities to form an entry taper between the two lobes 13*a* of the contact blades 13'.

Figures 37, 38, 39, 40, 41, 42, 43, 44, 45, 46, 47, 48, 49, 50:
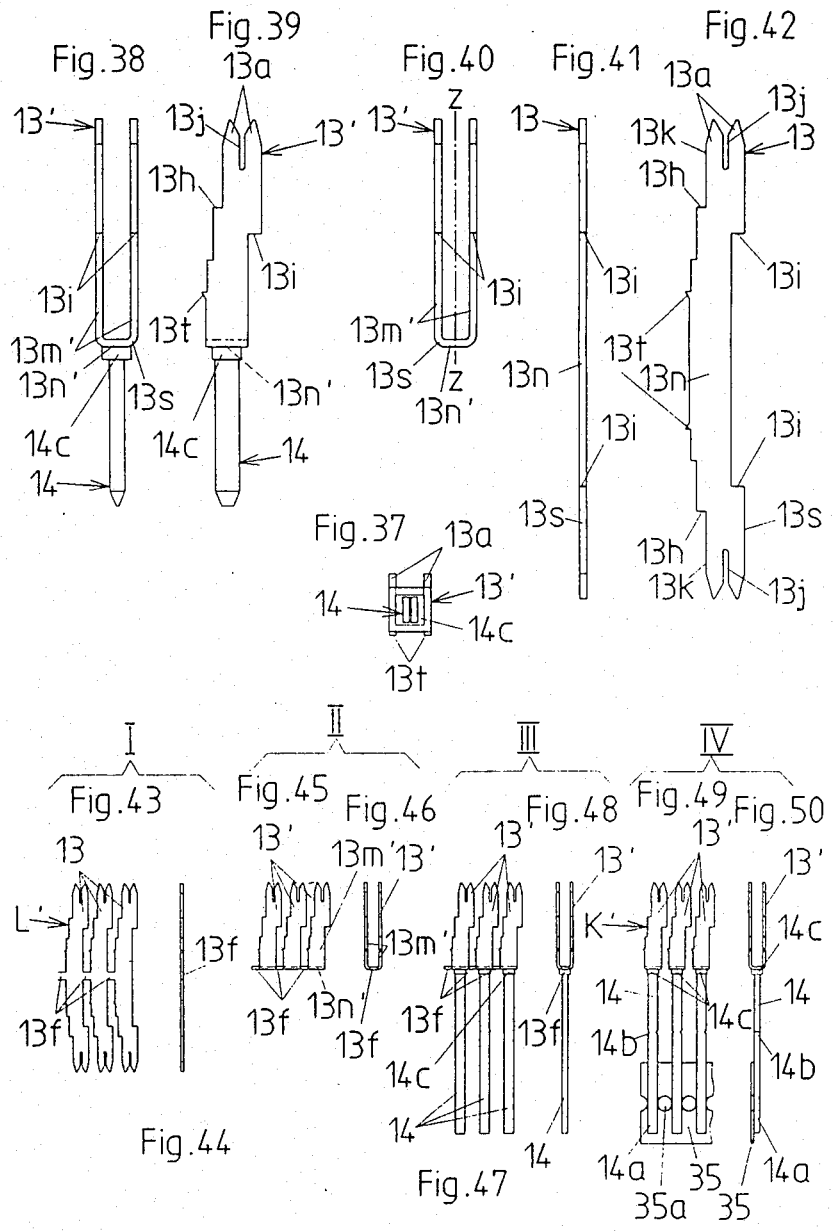
FIG. 37 is similar to FIG. 17, showing the upper composite contact post of FIG. 13 as seen from the free end of its plug pin.
FIG. 38 shows the lower composite contact post of FIG. 13 as seen in the longitudinal direction of the contact bar.
FIG. 39 shows the composite contact post of FIG. 38 as seen in the transverse direction of the contact bar.
FIG. 40 shows the cable-penetrating member of the contact post of FIG. 38.
FIG. 41 shows the cross-sectional outline of a sheet metal strip from which the cable-penetrating member of FIG. 40 is die-cut.
FIG. 42 shows the flat outline of a segment of a sheet metal strip which is formed into the cable-penetrating member of FIG. 40.
FIGS. 43–50 show stages I through IV in the production of a succession of attached composite contact post with cable-penetrating members and male plug pins.

To the lower side of the transverse web portion 13*n'* which links the two tines 13*m* is butt-welded a male plug pin 14 of rectangular cross section (FIGS. 37–39). As in the case of the female contact post 10/11, the attachment point for the plug pin 14 is located in the center of the transverse web portion 13*n'*, and the pin extends parallel to and halfway between the two planes defined by the tines 13*m*. At the attachment extremity, the plug pin 14 is likewise upset prior to the welding operation, forming an enlarged attachment head 14*c* for a larger weld area.

The upper contact post portions for both types of contact bars are obtained from a continuous strip of sheet metal in a progressive die-cutting operation which blanks out a succession of transversely oriented segments which remain attached to each other at a longitudinal pitch which is identical to the pitch of the contact post apertures in the contact post housing 17 or 23, respectively.

The U-shaped outline of the upper contact post portions is obtained by bending the flat segments in two right-angle bends along two longitudinal bending lines 10*s* (FIG. 18) or 13*s* (FIG. 38), respectively, which are parallel and equidistant from the center line of the sheet metal strip. The flat segments and the shaped upper contact post portions are symmetrical with respect to the center line of the sheet metal strip and with respect to a longitudinal vertical center plane z—z. The sheet metal strip is preferably a strip of rolled brass sheet.

With the solder pins 11 or plug 14 butt-welded to their transverse web portions 10*a'* and 13*n'*, respectively, the finished contact posts form continuous strips of attached contact posts which can be heat-treated as strips and rolled into a coil for storage and handling. The contact posts are only separated form each other, after they have been inserted into their contact post housing, as will be described further below.

The contact post apertures in the contact post housings are in both cases of rectangular cross section, at least on that side of the housing from which the contact posts are inserted, and the transverse web portions of the upper contact post portions have a matching rectangular outline as seen in the direction of the pin axis, so that the web portions of the inserted contact posts close off the lower openings of the contact post apertures much like a plug.

The contact posts 10/11 of the female contact bar F are inserted into their contact post housing 18 from below (FIG. 5), the contact posts being seated in the inserted position against two downwardly facing seating shoulders 17*g* FIG. 10 on the transverse sides of the contact post apertures 18 which engage the inner side of the the transverse web portions 10*a'*.

Figures 7, 8, 9, 10, 11, 12:
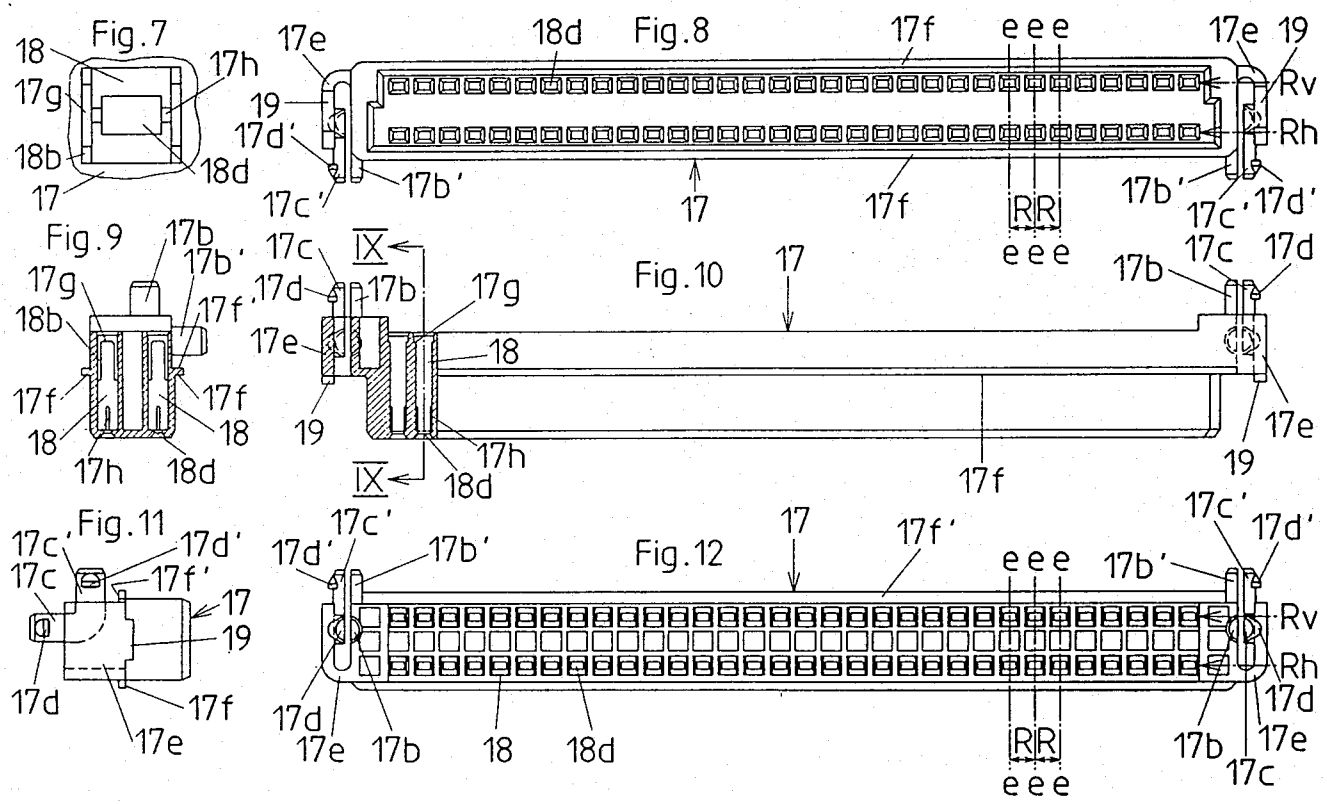
FIG. 7 is an enlarged detail of FIG. 12, representing the lower opening of a contact post aperture in the contact post housing of a female contact bar.
FIG. 8 shows the contact post housing of a female contact bar as seen from above.
FIG. 9 is a transverse cross section through the contact post housing taken along line IX—IX of FIG. 10.
FIG. 10 shows the contact post housing of FIGS. 8 and 9 in a partially cross-sectioned elevational view.
FIG. 11 shows the contact post housing in an end view.
FIG. 12 shows the contact post housing of FIGS. 8–11 as seen from below.
Figure 14:
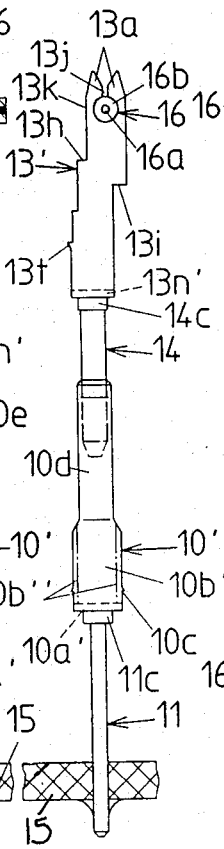
FIG. 14 shows the two composite contact posts of FIG. 13 as seen in the transverse direction of the contact bar.

FIG. 9 shows that the two seating shoulders 17*g* are flanked by two pairs of vertical positioning grooves 18*b* on the transverse sides of the contact post apertures 18. The grooves are engaged by edge portions 10*b''* of the upper contact post portions 10'. FIG. 14 shows that only the lower, parallel portions of the contact post tines 10*b'* engage the positioning grooves 18*b* in this way, the upper converging tine portions being narrower and therefore free to execute flexing movements to provide a pinching action against an inserted male plug pin. The positioning grooves 18*b* limit the deformability of the upper contact post portions to their narrower converging portions.

The entry extremities 10*e* of the converging flexible tine portions 10*d* are suitably flared away from each other to assure the smooth entry of a male plug pin between the tines. This entry is further facilitated through the arrangement of vertically oriented tine separating ribs 17*h* (FIG. 9) on the transverse walls of the contact post apertures, just below the pin openings 18*d* of the contact post housing 18. The separating ribs 17*h*, by engaging edge portions of the flexible tines at their entry extremities 10*e*, open the latter against their closing preload by a distance which is slightly less than the transverse width of a male plug pin 14.

The longitudinal distance between the two tine separating ribs 17*h* in the contact post apertures 18 is larger than the longitudinal width of the plug pin 14. Barbs 10*c* at the vertical edges of the contact post tines 10*b'* retain the inserted contact posts 10/11 in their seating apertures 18.

As can be seen in FIGS. 3–6, the contact post housing 17 of the female contact bar is selectively attachable to either a vertical or a horizontal printed circuit board. For this purpose the block-shaped housing 17 has on its longitudinal extremities two pairs of split centering plugs defined by vertically extending plug sections 17*b* and 17*d* and by horizontally extending plug section 17*b'* and 17*c'*.

The outer plug sections 17*d* and 17*c'* are portions of a flexible leg 17*e*, so that the centering plug sections squeeze together when inserted into a centering bore of the printed circuit board. Retaining noses 17*d* and 17*d'* at the outer extremities of the flexing plug sections 17*d* and 17*c'* produce a snap-action retention of the contact post housing 17 against the printed circuit board.

Figures 3, 4, 5, 6:
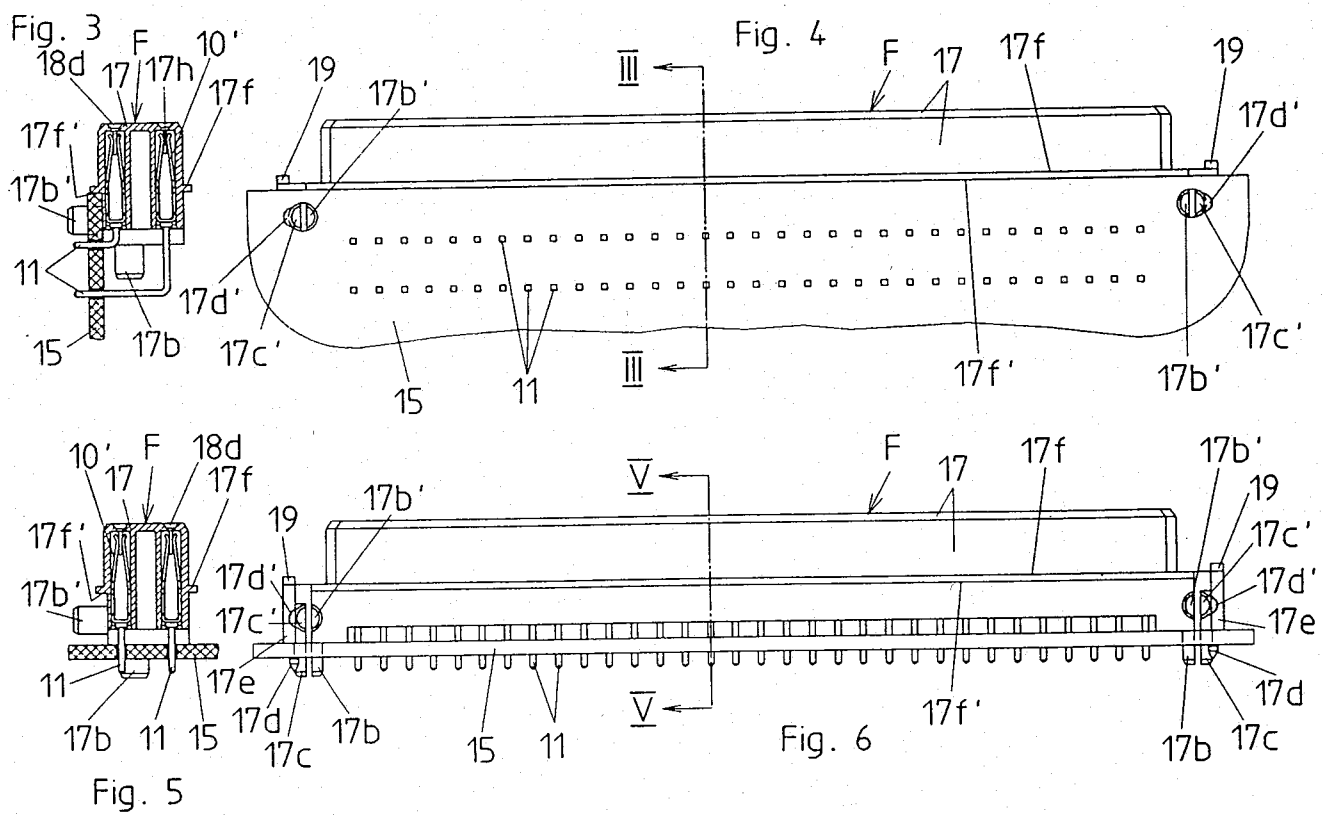
FIG. 3 shows the female contact bar of FIG. 1 in a transverse cross section taken along line III—III of FIG. 4, as attached to a vertical printed circuit board.
FIG. 4 shows the female contact bar of FIG. 3 in in an elevational view.
FIG. 5 shows the female contact bar of FIG. 1 in a cross section similar to that of FIG. 3, but attached to a horizontal printed circuit board.
FIG. 6 shows the female contact bar of FIG. 5 in in an elevational view.

FIGS. 3 and 4 show the attachment of a female contact bar to a vertical printed circuit board 15. In this case, the contact post housing protrudes above the upper edge of the printed circuit board 15, being positioned vertically against that edge by means of a lateral positioning shoulder 17*f*. The two rows of vertical solder pins 11 of the contact posts are angled off at different distances from their transverse web portions, to fit into two rows of horizontal solder sockets in the printed circuit board.

The lateral positioning shoulders 17*f* on the outside of the contact post housing 17 also serve to limit the depth of engagement of a male contact bar into a female contact bar. FIG. 1 shows that the lower edges of the plug connector housing thereby abut against the upper sides of the positioning shoulders 17*f*.

FIGS. 5 and 6 show the attachment of a female contact bar to a horizontal printed circuit board 15. Short solder pins 11 of the contact posts reach directly into the solder sockets of the printed circuit board. In this case, the capability of the transverse web portions 10*a'* of the contact posts to close off the contact post apertures comes in handy, as it prevents the penetration of solder and soldering vapors into the apertures.

The male contact bar, with the exception of its composite contact posts 13/14, is essentially identical to the male contact bar which is disclosed in my earlier-mentioned U.S. patent application Ser. No. 607,127 of May 4, 1984, the disclosure of which is hereby incorporated herein by reference.

Figure 51:
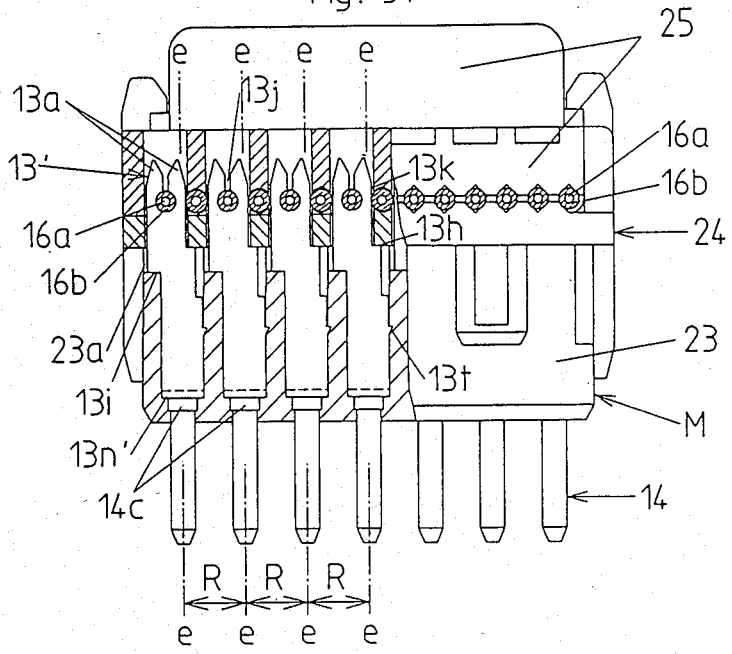
FIG. 51 shows, in a partially cross-sectioned elevational view, a short male contact bar with composite contact posts per FIGS. 39.
Figure 52:
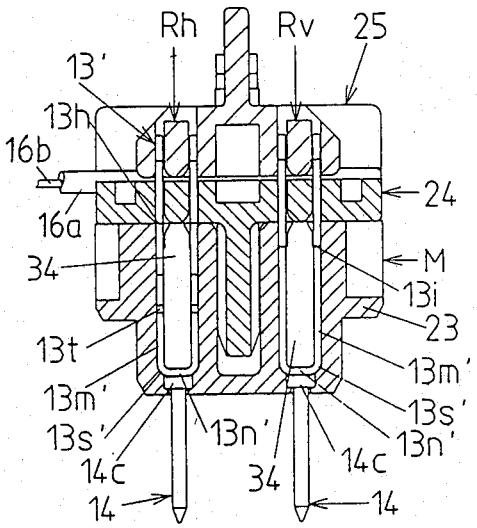
FIG. 52 shows the contact bar of FIG. 51 in a transverse cross section.

The composite male contact posts are inserted into their contact post apertures 34 (FIG. 53) from above, seated in the downward sense against seating ledges of the contact post apertures by means of downwardly facing shoulders 13*i* (FIG. 14), and retained in the upward sense by means of upwardly facing retaining shoulders 13*h* which are engaged by the bottom face of the lower clamping member 24 of the cable clamping assembly (FIG. 51).

In both cases, the contact blades of the two rows of contact posts are offset in the longitudinal sense by one-fourth of the longitudinal pitch, in order to cable-penetrating termination of a ribbon cable with a conductor pitch of one-half that distance.

Figure 54:
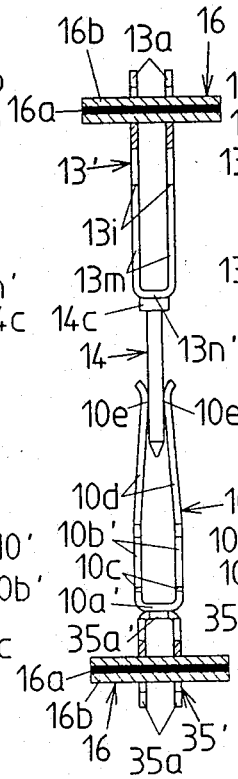
FIG. 54 shows, like FIG. 13, two different composite contact posts plugged together, the upper contact post consisting of a pair of cable-penetrating contact blades and a male plug pin, and the lower contact post consisting of a female contact member and another pair of cable-penetrating contact blades.
Figure 55:
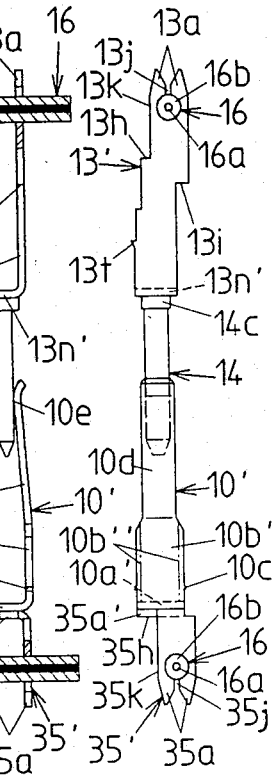
FIG. 55 shows the two composite contact posts of FIG. 54 as seen in the transverse direction of the contact bar.

FIGS. 54 and 55 show a third version of a composite contact post which is composed of two U-shaped contact post portions 10' and 35' which are attached to each other by means of a butt-weld at their transverse web portions 10*a'* and 35*a*, respectively. A contact bar with such a set of contact posts is used to terminate a ribbon cable with cable-penetrating female contact members.

FIG. 54 shows that, in cooperation with a contact bar with cable-penetrating male plug pins, as described above, it is thus possible to establish a coupling between two lengths of ribbon cable without the need for a stationary contact bar.

The lower contact post portion 35' of the female cable-termination contact bar is basically similar to the upper contact post portion 13 of the male cable-terminating contact bar (FIGS. 38 and 39), having the same longitudinal offset in relation to its female upper contact post portion 10, in order to permit the cable-penetrating connection to the conductors of a half-pitch ribbon cable.

However, the contact post portion 35' differs from the contact post portion 13, inasmuch as it is shorter and substantially the entire length of its contact blades 35*a* is located on the outside of the contact post housing (not shown). The longitudinal offset is conveniently provided at the transverse web portion 35*a'* of the shorter, lower contact post portion 35'.

The manufacturing method of the invention suggests the production of the composite contact posts as a succession of mutually attached contact post from a sheet metal strip of rolled brass. In the case of the female contact post with solder pin, it involves five stages I through V, as represented by FIGS. 27 through 36 of the drawing.

In stage I, a succession of transversely oriented flat strip segments are blanked form the sheet metal strip, the segments remaining attached to each other in the area of the longitudinal center plane z—z by means of bridge portions 10*f*.

In stage II, the flat contact post segments are bent by a small angle along two longitudinal bending lines approximately midway between the center plane and the segment extremities. These bends create the convergence of the flexible upper tine portions 10' of the female contact members.

In stage III, the attached contact post segments are subjected to a right-angle bending operation along two equidistant bending lines 10*s* (FIG. 21) which are spaced a small distance from the center plane z—z, thereby closing the flexible tine portions 10' against each other and producing the transverse web portions 10*a'*.

In stage IV, an over-length solder pin 11 of contact bronze is butt-welded to each upper contact post portions, at the outer side of its transverse web 10*a'*. The butt-welding operation involves the use of electrical resistance heating. Alternatively, it is also possible to use laser beams as a heat source. The laser beams are preferably aimed at the welding interface between the extremity of solder pin 11 and the outer side of the transverse web portion 10*a'* at a small angle from the latter. It has been found that, under certain circumstances, the use of laser beams as a heat source makes it possible to dispense with an enlarged attachment head at the extremity of the solder pin 11.

In stage V, the free extremities of the over-length solder pins 11 are attached to a carrier strip 12, while the upper contact post portions 10' are separated from each other by removing the connecting bridge portions 10*f*. At the same time, the solder pins 11 are weakened at a point 11*b* which corresponds to the finished length of the pins, the weakening points providing entry tapers at the tips of the solder pins. These contact posts are conveniently rolled into a coil for storage.

When the contact posts are inserted into the contact post housing of a female contact bar, a number of segments corresponding to the length of a row of contact post apertures 18 in the housing 17 is inserted into the latter from underneath, while still attached to the carrier strip 12. Following insertion of the contact posts, the carrier strip is severed from the latter at the weakening points 11*b* of the solder pins by a simple breakaway bending action.

The cable-penetrating male contact posts are manufactured in a similar manner. Only one right-angle bending operation, as represented by stage II of FIGS. 45 and 46 is required. The contact post segments remain attached to each other by means of lateral carrier strips which are similar to those suggested in my above-mentioned copending application Ser. No. 607,127 of May 4, 1984. To the transverse web portion 13*n*′ of each upper contact post portion is butt-welded a male plug pin 14, the welding conditions being substantially the same as in the case of the earlier-mentioned solder pin 11.

Figure 53:
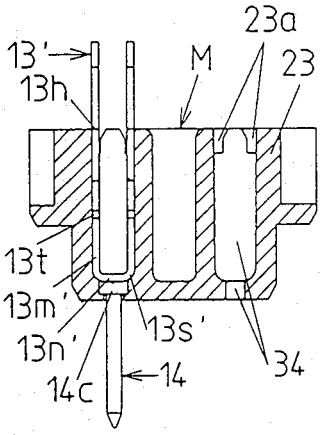
FIG. 53 shows the contact post housing of FIG. 52 with an empty and an occupied contact post aperture.

Insertion of the male contact posts into the contact post apertures 34 of their contact post housing 23 takes place from above, as shown in FIG. 53. Two coils of contact post segments are fed to the two rows of apertures from opposite longitudinal ends of the housing, in order to achieve their opposite longitudinal offsets. The breakaway separation of the carrier strips from the inserted contact posts is performed in the same manner as is disclosed in said copending application Ser. No. 607,127.

It should be understood, of course, that the foregoing disclosure describes only a preferred embodiment of the invention and that it is intended to cover all changes and modifications of this example of the invention which fall within the scope of the appended claims.

I claim the following:

1. A pluggable multi-pin contact bar for the connection of a large number of narrowly spaced electrical leads of a printed circuit board or of a flat ribbon cable to the leads of a mating multi-pin contact bar, the pluggable contact bar comprising in combination:

an elongated block-shaped horizontal contact post housing of injection-molded plastic material, the housing having opposite upper and lower longitudinal sides;

at least one row of contact post apertures extending vertically through the contact post housing and defining a vertical contact post center plane, the contact post apertures being spaced at a regular longitudinal pitch;

vertical contact posts engaged in the contact post apertures of the contact post housing;

means for vertically seating the contact posts in their contact post apertures;

an elongated horizontal lower clamping member of injection-molded plastic material defining on its upper side an upwardly facing groove bed with a row of regularly spaced, horizontally transversely oriented conductor positioning grooves;

a similar horizontal upper clamping member defining on its lower side a matching downwardly facing groove bed with a row of conductor positioning grooves;

first latching means operable to join said upper and lower clamping members into a clamping assembly in which the groove beds of the clamping members cooperate to clamp between them the insulated conductors of a multi-conductor ribbon cable;

second latching means operable to join the clamping assembly to the contact post housing in such a way that the lower side of its lower clamping member adjoins the upper side of the housing; and wherein each contact post includes an upper contact post portion of U-shaped outline defined by a pair of substantially parallel vertical tines on opposite sides of and equidistant from a vertical contact post center plane and a transverse web portion joining the vertical tines at their lower extremities, the upper contact post portion being a cable-penetrating contact member, its two vertical tines defining two yoke-shaped blades with transversely aligned, vertically oriented central blade slots which are open at the upper extremity of the contact blades, where they form a diverging entry taper;

the upper and lower clamping members have vertically aligned guide slots adapted to receive therein the contact blades of the contact posts, so that, when a pair of contact blades of a contact post is engaged into a guide slot, the contact blades penetrate and displace the insulation of a clamped conductor on both sides of its conductive strand and the latter is wedged between the flanks of the contact slots of the two contact blades, thereby establishing electrical connection between the contact post and the conductive strand on two longitudinally spaced points of said strand;

each contact post further includes a lower contact post portion in the form of a thin vertical contact pin which is aligned with the vertical contact post center plane and protrudes downwardly from the contact post aperture, the vertical contact pin being a male plug pin adapted to be plugged into a female contact member; and each contact pin has its upper extremity upset to form an enlarged attachment head by which it is butt-welded to the underside of the transverse web portion of the upper contact post portion.

2. A multi-pin contact bar as defined in claim 1, wherein the contact post apertures in the contact post housing are arranged in two parallel rows of apertures, defining two parallel vertical contact pin center planes, the two rows of apertures having pin openings arranged at the same longitudinal pitch and aligned in pairs, as seen in a direction perpendicular to said center planes;

the contact posts have their contact blades offset from their male plug pins in the longitudinal sense of the housing to such an extent that the vertical blade slots of their contact blades are out of alignment with the vertical plug pins by one-quarter of the longitudinal pitch of the contact post apertures;

the two rows of contact posts engaged in the contact post apertures have their respective contact blades offset in the opposite longitudinal sense, so that the contact blades of one row are offset from the contact blades of the other row by one-half of said longitudinal pitch; and the pitch of the conductor positioning grooves of the two clamping members is equal to one-half said longitudinal pitch.

3. A multi-pin contact bar as defined in claim 2, wherein the contact post apertures in the contact post housing have an opening on the upper side of the housing through which the cable-penetrating contact member is inserted, and a smaller pin opening on the lower side of the housing through which the plug pin extends downwardly from the housing;

the longitudinal offset of the contact blades is the result of an offset in the midportion of the two vertical tines of the upper contact post portion, forming a downwardly facing seating shoulder on one edge and an upwardly facing retaining shoulder on the other edge thereof;

the contact post apertures have upwardly facing seating ledges cooperating with the downwardly facing seating shoulders of the contact posts; and the upwardly facing retaining shoulders of the contact posts are substantially aligned with the upper side of the contact post housing, cooperating with retaining surfaces on the lower side of the lower clamping member to secure the contact post against the seating shoulders in the contact post apertures.

4. A pluggable multi-pin contact bar for the connection of a large number of narrowly spaced electrical leads of a printed circuit board or of a flat ribbon cable to the leads of a mating multi-pin contact bar, the pluggable contact bar comprising in combination:

an elongated block-shaped horizontal contact post housing of injection-molded plastic material, the housing having opposite upper and lower longitudinal sides;

at least one row of contact post apertures extending vertically through the contact post housing and defining a vertical contact post center plane, the contact post apertures being spaced at a regular longitudinal pitch;

vertical conatct posts engaged in the contact post apertures of the contact post housing; and means for vertically seating the contact posts in their contact post apertures; and wherein each contact post includes an upper contact post portion in the form of a U-shaped female contact member defined by a pair of substantially parallel vertical tines on opposite sides of and equidistant from a vertical contact post center plane and a transverse web portion joining the vertical tines at their lower extremities, the two vertical tines having converging upper end portions adapted to receive between them a male plug pin, while being forcibly separated by said plug pin, the upper contact post portion yielding resiliently to permit said separation, while applying a pinching contact force against said plug pin;

each contact post further includes a lower contact post portion in the form of a cable-penetrating contact member of U-shaped outline with a pair of substantially parallel vertical tines and a transverse web portion joining the two tines at their upper extremities, the two vertical tines defining two yoke-shaped contact blades with transversely aligned vertically oriented central blade slots which are open at the lower extremity of the contact blades, where they form a diverging entry taper; and the web of the lower contact post portion is butt-welded to the web of the upper contact post portion.

5. A multi-pin contact bar as defined in claim 4, wherein the contact post apertures in the contact post housing are arranged in two parallel rows of apertures, defining two parallel vertical contact post center planes, the two rows of apertures having openings arranged at the same longitudinal pitch and aligned in pairs, as seen in a direction perpendicular to said center planes;

the contact posts have their contact blades offset from their female contact members in the longitudinal sense of the contact post housing to such an extent that the vertical blade slots of their contact blades are out of alignment with the vertical tines of the female contact member by one-quarter of the longitudinal pitch of the contact post apertures;

the two rows of contact posts engaged in the contact post apertures have their lower contact post portions protruding downwardly from the lower side of the contact post housing and their respective contact blades offset in the opposite longitudinal sense, so that the contact blades of one row are offset from the contact blades of the other row by one-half of said longitudinal pitch; and the conductor pitch of a ribbon cable connectable to the cable-penetrating contact blades of the two rows of contact posts is equal to one-half said longitudinal pitch.

* * * * *